United States Patent [19]

Cutler

[11] 4,295,622

[45] Oct. 20, 1981

[54] FRAMEWORK HOLDER FOR ATTACHING CONTAINER TO FLOOR MACHINE

[76] Inventor: Barry L. Cutler, 7 Stanford Ct., East Windsor, N.J. 08520

[21] Appl. No.: 152,617

[22] Filed: May 23, 1980

[51] Int. Cl.[3] ..... A47K 1/08

[52] U.S. Cl. ..... 248/313; 15/50 R; 248/154

[58] Field of Search ..... 248/146, 154, 149, 150, 248/151, 152, 310, 311.2, 313; 15/246, 50 R

[56] References Cited

U.S. PATENT DOCUMENTS

| | | | |
|---|---|---|---|
| D. 154,966 | 8/1949 | Walsh | 248/146 UX |
| 741,787 | 10/1903 | Gossack | 15/50 R |
| 1,329,474 | 2/1920 | Pregler | 15/50 R |
| 1,569,825 | 1/1926 | Major | 248/154 X |
| 2,482,575 | 9/1949 | Cohn | 248/231 X |
| 2,893,037 | 7/1959 | Strong | 15/50 R |
| 2,958,881 | 11/1960 | Kazimierczak | 15/50 R |
| 2,960,785 | 11/1960 | Kies | 248/231 X |
| 3,036,321 | 5/1962 | Holt | 15/50 R |
| 3,115,213 | 12/1963 | Cloutier | 248/231 X |
| 3,802,717 | 4/1974 | Eitreim | 248/154 X |

*Primary Examiner*—J. Franklin Foss

*Attorney, Agent, or Firm*—Raymond Underwood

[57] ABSTRACT

A framework structure for holding a fluid container on a floor machine is made up of three uprights which are attachable to the machine and have retaining means which hold encircling bands which clamp the container within the uprights.

4 Claims, 8 Drawing Figures

FIG. 1
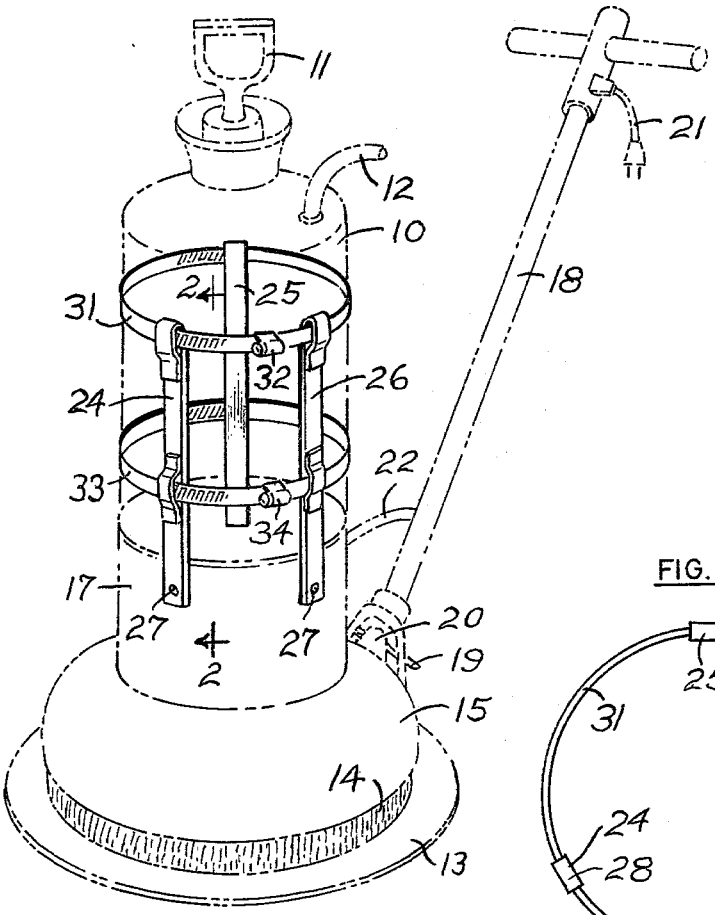
FIG. 2
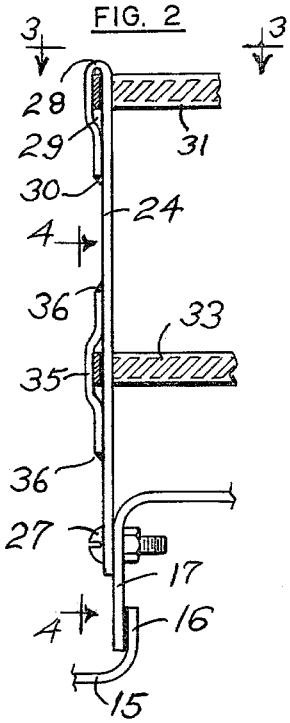
FIG. 3
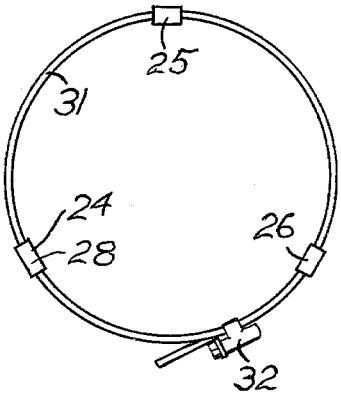
FIG. 4
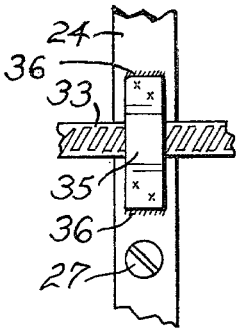
FIG. 5
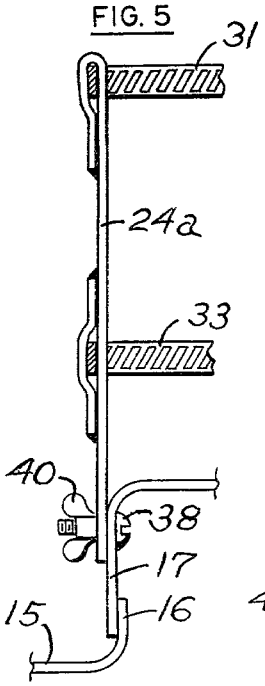
FIG. 7
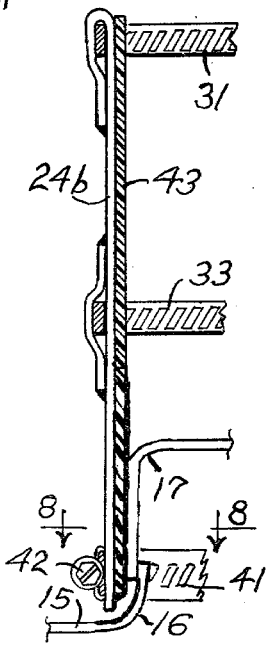
FIG. 6
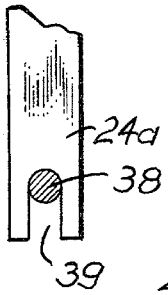
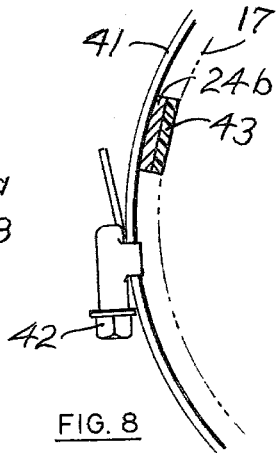
FIG. 8

FRAMEWORK HOLDER FOR ATTACHING CONTAINER TO FLOOR MACHINE

This invention relates to floor or carpet cleaning and polishing machines and particularly to a readily attachable framework for holding a container of cleaning or polishing fluid.

The machines to which the framework holder of this invention are to be attached include a motor driven, large disc-like brush which drives a cleaning pad against the floor or carpet. In cleaning a floor or carpet a cleaning fluid is spread or sprayed on the surface to be cleaned and then the brush, while rotating about its axis, drives a cleaning pad back and forth over the surface. In like manner, if a floor is to be waxed and buffed, the selected fluid is spread on the floor and then the machine is applied so its brush and pad performs the actual polishing.

The fluid to be applied is, of necessity, in a container and a common practice is to pressurize the container so that its contents can be sprayed on the surface to be worked on. Usually, the fluid is sprayed on separate portions of the surface at a time and the container is set aside after each individual application. Then, for the next sectional application, the workman must go to the container to retrieve it, to spray on the selected area and then put the container aside out of the way. Obviously, this requires considerable back and forth walking and a waste of time.

To avoid this walking, schemes have been devised to carry the fluid container on the machine but they have not been satisfactory especially considering the large amount of the liquid to be used. For instance, U.S. Pat. No. 3,071,792 issued to P. Rachlin on Jan. 8, 1963 shows a container 32 fastened to the upper end of the handle shaft 20 and it is obvious that this is unsatisfactory if the container is to hold a gallon or more; at that location the workman is holding it up all of the time. This objection is true of the J. P. Kenny U.S. Pat. No. 3,094,152 dated June 18, 1963.

The location of the fluid container above the wheeled vehicle is shown in U.S. Pat. No. 2,719,754 dated Oct. 4, 1955 to E. H. Weller but it obviously is an expensive and complex arrangement. U.S. Pat. No. 3,290,716 to R. E. Cain of Dec. 13, 1966 shows another cumbersome way of supporting the fluid container above a wheeled vehicle. These patents show the need for a simple construction for holding a cleaning or polishing fluid container on a floor or carpet cleaning or buffing machine.

The structure of the present invention is a framework which can readily be applied to most floor treating machines and which will firmly hold the fluid container. Moreover, the empty container can quickly be refilled with a full one without having to remove the framework from the machine.

Representative examples of the invention are illustrated in the accompanying drawings in which:

FIG. 1 is a perspective view of the container holding framework attached to a floor machine, the container being shown in construction lines, FIG. 2 is a sectional view on the line 2—2 of FIG. 1 on an enlarged scale, a portion only being shown, FIG. 3 is a plan view taken on the line 3—3 of FIG. 2 of the framework, FIG. 4 is a partial, sectional view on the line 4—4 of FIG. 2, FIG. 5 is a view similar to FIG. 2 but of a modification of the invention, FIG. 6 is a front elevation view of the lower end of the vertical strut in FIG. 5

FIG. 7 is like FIG. 2 but it shows another variation and

FIG. 8 is a section on the line 8—8 of FIG. 7.

FIGS. 1 to 4 inclusive show a preferred embodiment of the invention and should be referred to first. As is stated above, the fluid container 10 is shown in construction lines as it is not a part of the invention; it is representative of a variety of containers of different materials which are to be held by the framework of the invention. It has the pressure pump 11 and the hose 12 which terminates in a valved nozzle which is not shown.

The bristles of the brush are shown at 14 and they are of the firm or stiff type which is conventionally known, so they can frictionally drive the pad 13. Instead of a brush with bristles the usual cloth or buffing material may be present but in any case it or the brush would be rotatable by a motor (not shown). The brush and motor are supported in a housing of which the inverted dish-shaped body 15 is a part.

This body 15 has a central upstanding cylinder 16 (FIG. 2) within which the motor itself is housed. To protect the motor an inverted cup-shaped or dome cover or canopy 17 fits down on the cylinder 16. It will ordinarily have a press fit but it may be held in place by screws or bolts for example. This cover or canopy 17 serves as the place for attachment of the container holding framework of the invention.

To guide the machine a handle 18 is pivotally connected at 19 to a stud protuberance 20 of the housing body 15. In commercial practice this handle and its attachment to the machine takes a variety of forms and the simple one shown is for representative purposes only. An electric wire 21 with a switch in it leads to the top of the handle and it continues at 22 to the motor. Ordinarily, wheels (not shown) are provided to wheel the machine across the floor with the brush up, off the floor.

The framework of the invention includes the three upright straps or bands 24,25 and 26 which are each attached to the canopy 17 by the screws 27. Other attachment means at this location will be described. Three upright straps are shown as they are preferred for a firm structure but four or more may be used for greater strength. These upright straps serve as standards around the fluid container to embrace it.

The tops of the uprights are turned over on themselves as shown at 28 and are spot welded as is shown at 30, for the upright 24 in FIG. 2. This forms a closed recess 29 which will receive a circular band or loop 31. This circular loop 31 is of a size to encircle the container and uprights and it preferably is of the conventional type in which one end of the band is attached to a head 32 with a rotatable coarse screw in it which engages in transverse slots of the band. (See FIGS. 3 and 4)

A similar encircling band 33 with its tightening head 34 is located so as to lie a little above the bottom of the fluid container. To assist in holding it in place it is held in a clip 35 which is spot welded at both of its ends as at 36 in FIG. 4 to the upright 24. This clip is attached to all of the uprights.

This container holding framework is easily attached to the machine and this may be done in several ways. One assembly procedure is to fasten the uprights 24,25 and 26 to the cover 17 when it is off the cylinder 16, using the bolts 27. Then the encircling loops 31 and 33 are put in place and the assembly is completed. To remove it the above steps are reversed and this is obviously easily accomplished. Other assembly steps are obvious.

The framework parts are to be made of stainless steel to prevent corrosion from cleaning fluid. The selection of the size of the uprights and the encircling bands will be evident to a skilled workman and they ordinarily will be chosen from stock material. The formation of the clip 35 and recess it forms for the band 33 will be obvious.

FIG. 5 shows a modified, simple attachment of the framework of the invention to the dome cover 17. In this case the bolt 38 is either welded to the cover 17 or it is slipped through a drilled hole in the cover 17 so it projects outwardly. The lower end of the upright 24*a* is notched upwardly at 39 as shown in FIG. 6 so that the upright merely has to be moved down over the bolt 38 to place the lower end of 24*a* on the bolt 38. Then the wingnut 40 is threaded and tightened on the bolt. The remainder of the construction is as shown in FIG. 2. This method of attachment enables rapid mounting and dismounting.

FIG. 7 shows another modification. Instead of bolts 27 and 38 the lower ends of the uprights are held firmly against the cover 17 by means of the encircling loop or band 41. By tightening the bolt 42, as is apparent from FIG. 8, the upright 24*b* and the other uprights are held firmly against the cover 17. The remainder of the structure is the same as has been described.

As stated above, there can be more than three of the upright standards or bands 24,25 and 26 and all should be parallel to each other and be arranged around a circle. To receive and hold a larger container the bands 31 and 33 are supplied with extra length to enable the assembly to be adjusted to fit around any pressure sprayer and any machine top.

To more firmly and frictionally hold the fluid container in place the standards may have a rubber strip (as 43 in FIG. 7) affixed to their inner faces. This rubber or like material will prevent slippage of the container despite rough handling of the machine.

I claim:

1. A holder of framework structure for removably attaching a fluid container to floor and carpet cleaning and polishing machines which comprises at least three parallel elongated upright standards spaced from each other around a circle, an adjustable, encircling strap at the lower ends of the standards for drawing the standards closer together to press them frictionally against a machine for detatchably securing them to such a machine, retaining means carried by the standards and forming recesses for receiving and holding said lower encircling strap in place on the standards, an adjustable top encircling strap at the upper ends of said standards to draw them into frictional engagement with a fluid container, and retaining means at said upper ends of the standards and forming recesses for receiving and for holding said top encircling strap in place.

2. A holder according to claim 1 in which said retaining means is an end portion of each standard bent over on itself to form a recess in which the strap is located.

3. A holder according to claim 1 in which said retaining means for holding the strap is a clip affixed to and carried by each standard and forming the recess to receive the strap.

4. A holder of framework construction for removably attaching a fluid container to floor and carpet cleaning and polishing machines which comprises at least three parallel elongated upright standards spaced from each other around a circle, the lower ends of the standards having notches which open out to the edge thereof to slide over and receive attachment bolts carried by the machine to detatachably secure the standards to the machine, an adjustable top encircling strap at the upper ends of said standards to draw them into frictional engagement with a fluid container, and retaining means at said upper ends of the standards and forming recesses for holding said top encircling strap in place.

* * * * *